US009599116B1

(12) United States Patent
Winger

(10) Patent No.: US 9,599,116 B1
(45) Date of Patent: Mar. 21, 2017

(54) AIR PARTICLE COLLECTION PAD ADHERED TO FAN BLADE

(71) Applicant: Alexander Winger, Orlando, FL (US)

(72) Inventor: Alexander Winger, Orlando, FL (US)

( * ) Notice: Subject to any disclaimer, the term of this patent is extended or adjusted under 35 U.S.C. 154(b) by 612 days.

(21) Appl. No.: 14/048,902

(22) Filed: Oct. 8, 2013

(51) Int. Cl.
*F04D 25/08* (2006.01)
*F04D 29/70* (2006.01)
*F04D 29/38* (2006.01)
*F04D 29/32* (2006.01)

(52) U.S. Cl.
CPC ..... *F04D 25/088* (2013.01); *F04D 29/325* (2013.01); *F04D 29/388* (2013.01); *F04D 29/703* (2013.01); *F05D 2240/306* (2013.01)

(58) Field of Classification Search
CPC ..... F04D 25/088; F04D 29/703; F04D 29/34; F04D 29/005; F04D 29/325; F04D 29/38; F04D 29/388; F05D 2240/306
USPC ..... 416/210 R, 146 R
See application file for complete search history.

(56) References Cited

U.S. PATENT DOCUMENTS 4,753,573 A * 6/1988 McKnight ..... F24F 3/1603 416/146 R
5,336,286 A * 8/1994 Alexander, Jr. ..... B01D 39/163 55/528
5,370,721 A * 12/1994 Carnahan ..... B01D 39/1623 416/62
5,383,765 A * 1/1995 Baxter ..... A61L 9/12 261/84
5,458,463 A * 10/1995 Chiang ..... F04D 25/088 416/210 R
5,775,876 A * 7/1998 Walker ..... A61L 9/122 239/56
6,779,976 B1 * 8/2004 Carfagna ..... F04D 25/088 416/146 R
6,857,852 B1 * 2/2005 Carfagna ..... F04D 29/703 416/146 R
8,025,481 B2 * 9/2011 Foxworth ..... F04D 25/088 416/62
2006/0251541 A1 * 11/2006 Santandrea ..... G06Q 10/06375 422/5
2012/0224967 A1 * 9/2012 Radabaugh ..... F04D 25/088 416/62

* cited by examiner

*Primary Examiner* — Richard Edgar
*Assistant Examiner* — Jesse Prager

(57) ABSTRACT

A ceiling fan has a plurality of blades with upper and lower surfaces. Each blade has side edges and arcuate convex interior and exterior edges forming a blade periphery. A plurality of similarly configured pads have upper and lower surfaces. Each pad has side and interior and exterior edges forming a pad periphery. The pads are fabricated of a synthetic microfiber material. Each peel strip of a plurality of peel strips has a size and shape of an associated pad. An adhesive is in contact with the lower surface of each pad removably coupling the lower surface of each pad to a peel strip. The peel strips are adapted to be removed from the pads and the pads removably coupled to the upper surfaces of the blades.

1 Claim, 3 Drawing Sheets

FIG. 1
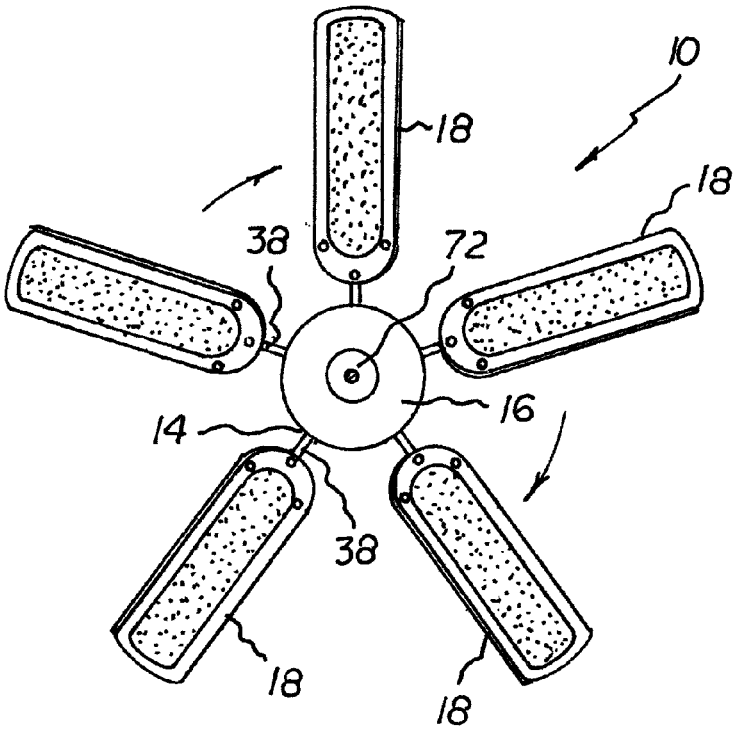
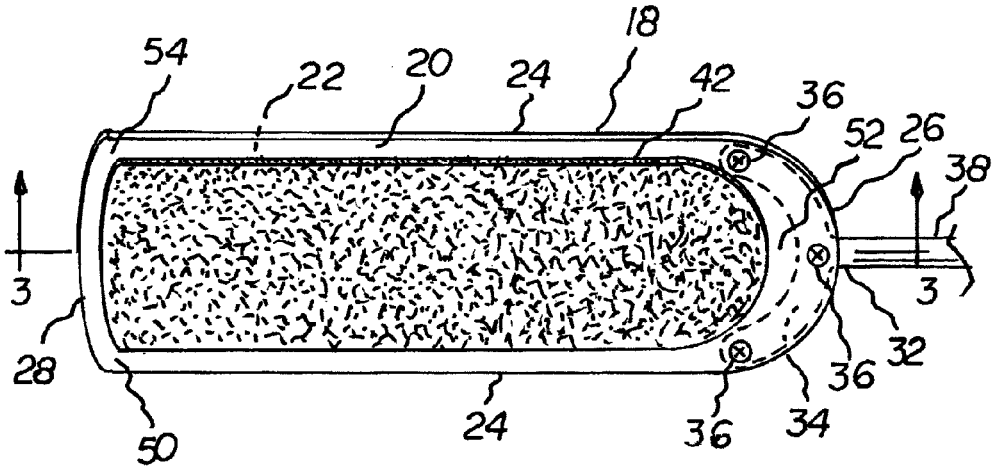
FIG. 2

FIG. 3
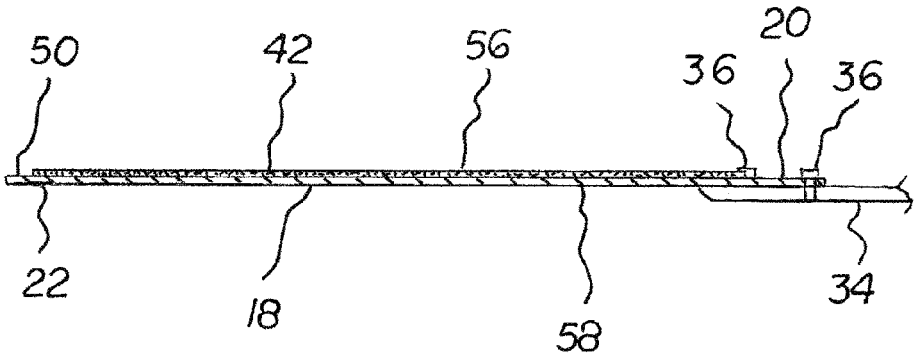
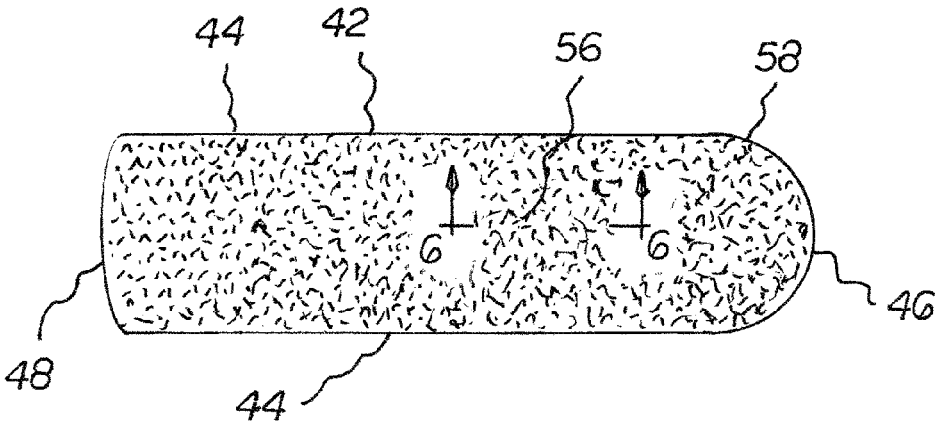
FIG. 4

FIG. 5
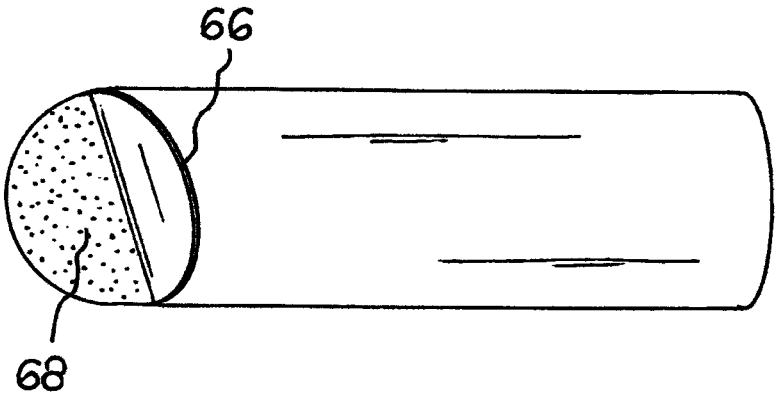
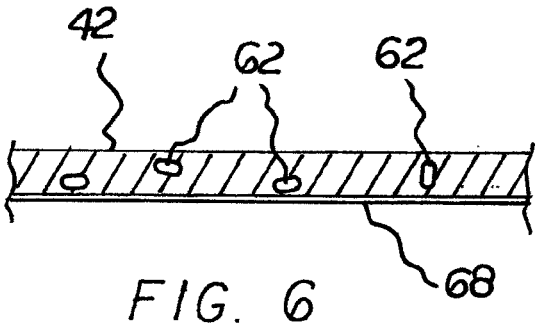
FIG. 6
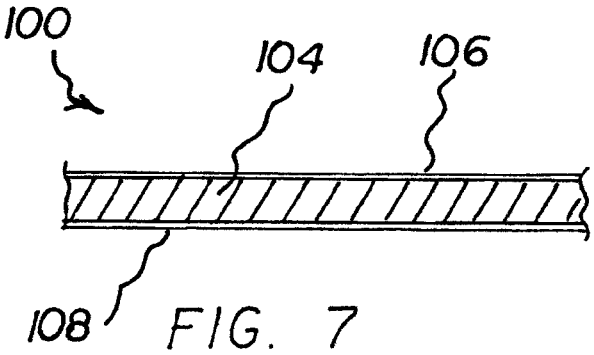
FIG. 7

AIR PARTICLE COLLECTION PAD ADHERED TO FAN BLADE

BACKGROUND OF THE INVENTION

1. Field of the Invention

The present invention relates to an air particle collection pad adhered to a fan blade and more particularly pertains to adhesively coupling collection pads to upper surfaces of ceiling fan blades and to rotating the ceiling fan blades and collection pads to attract and collect dust, pollen, air pollutants, airborne chemicals, various molds, spores, and harmful fibers in the environment.

2. Description of the Prior Art

The use of fans and cleaning deices is known in the prior art. More specifically, fans and cleaning devices previously devised and utilized for the purpose of cleaning an cooling rooms are known to consist basically of familiar, expected, and obvious structural configurations, notwithstanding the myriad of designs encompassed by the crowded prior art which has been developed for the fulfillment of countless objectives and requirements.

While known devices fulfill their respective, particular objectives and requirements, the prior art does not describe an air particle collection pad adhered to fan blade that allows cooling and cleaning with pads on upper surfaces of ceiling fan blades.

In this respect, the air particle collection pad adhered to fan blade according to the present invention substantially departs from the conventional concepts and designs of the prior art, and in doing so provides an apparatus primarily developed for the purpose of concurrently cooling and cleaning rooms.

Therefore, it can be appreciated that there exists a continuing need for a new and improved air particle collection pad adhered to fan blade which can be used for concurrently cooling and cleaning rooms. In this regard, the present invention substantially fulfills this need.

SUMMARY OF THE INVENTION

In view of the foregoing disadvantages inherent in the known types of fans and cleaning systems now present in the prior art, the present invention provides an improved air particle collection pad adhered to fan blade. As such, the general purpose of the present invention, which will be described subsequently in greater detail, is to provide a new and improved air particle collection pad adhered to fan blade which has all the advantages of the prior art and none of the disadvantages.

To attain this, the present invention essentially comprises a ceiling fan having a plurality of blades with upper and lower surfaces. Each blade has side edges and arcuate convex interior and exterior edges. The side, exterior and interior edges of the blade forming a blade periphery. A plurality of similarly configured pads have upper and lower surfaces. Each pad has side and interior and exterior edges. The side and exterior and interior edges of the pad form a pad periphery. The pads are fabricated of a synthetic microfiber material. A plurality of peel strips are provided. Each peel strip has a size and shape of an associated pad. An adhesive is in contact with the lower surface of each pad removably coupling the lower surface of each pad to a peel strip. The peel strips are adapted to be removed from the pads and the pads removably coupled to the upper surfaces of the blades.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved air particle collection pad adhered to fan blade which has all of the advantages of the prior art fans and cleaning devices and none of the disadvantages.

It is another object of the present invention to provide a new and improved air particle collection pad adhered to fan blade which may be easily and efficiently manufactured and marketed.

It is a further object of the present invention to provide a new and improved air particle collection pad adhered to fan blade which is of durable and reliable constructions.

An even further object of the present invention is to provide a new and improved air particle collection pad adhered to fan blade which is susceptible of a low cost of manufacture with regard to both materials and labor, and which accordingly is then susceptible of low prices of sale to the consuming public, thereby making such air particle collection pad adhered to fan blade economically available to the buying public.

Even still another object of the present invention is to provide an air particle collection pad adhered to fan blade for concurrently cooling and cleaning with ceiling fans having blades and micro-fiber pads adhesively secured to the upper surfaces of the blades.

Lastly, it is an object of the present invention to provide a new and improved air particle collection pad adhered to fan blade for adhesively coupling collection pads to upper surfaces of ceiling fan blades and for rotating the ceiling fan blades and collection pads to attract and collect dust, pollen, air pollutants, airborne chemicals, various molds, spore, and harmful fibers in the environment. The coupling and rotating and attracting and collecting are done in a safe, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of an air particle collection pad adhered to fan blade constructed in accordance with the principles of the present invention.

FIG. 2 is an enlarged plan view of one fan blade as shown in FIG. 1.

FIG. 3 is a cross sectional view taken along line 3-3 of FIG. 2.

FIG. 4 is an enlarged plan view of one pad as shown in the prior Figures.

FIG. 5 is a bottom view of one pad as shown in FIG. 4 with the peel strip partially removed.

FIG. 6 is a cross sectional view taken along line 6-6 of FIG. 4.

FIG. 7 is a cross sectional view similar to FIG. 6 but illustrating an alternate embodiment of the invention.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved air particle collection pad adhered to fan blade embodying the principles and concepts of the present invention and generally designated by the reference numeral 10 will be described.

The present invention, the air particle collection pad adhered to fan blade 10 is comprised of a plurality of components. Such components in their broadest context include a ceiling fan with blades in combination with pads having adhesive and peel strips to be removed to allow coupling the pads to the blades on upper surfaces. Such components are individually configured and correlated with respect to each other so as to attain the desired objective.

The air particle collection pad adhered to fan blade 10 of the present invention is for adhesively coupling collection pads to upper surfaces of ceiling fan blades and for rotating the ceiling fan blades and collection pads to attract and collect dust, pollen, air pollutants, airborne chemicals, various molds, spores, and harmful fibers in the environment. The coupling and rotating and attracting and collecting is done in a safe, convenient and economical manner. The system first includes a ceiling fan 14 having a central base 16 with five similarly configured ceiling fan blades 18. The central base depends from and is adjacent to a ceiling of a room to be cleaned and cooled. Each ceiling fan blade of the five similarly configured ceiling fan blade has an upper surface 20 and a lower surface 22. Each blade has an elongated configuration in a generally horizontal plane with parallel side edges 24 and an arcuate convex interior edge 26 and an arcuate convex exterior edge 28. The exterior and interior edges each have a center of curvature with the center of curvature of the exterior edges having a greater radius of curvature than the radius of curvature of the interior edges. The side edges and exterior edges and interior edges of the blade form a blade periphery. The blades are preferably fabricated of rigid material such as wood, plastic, fiberglass, etc.

Five similarly configured coupling assemblies 32 are provided. Each coupling assembly includes an exterior component 34 in an arcuate configuration positioned on the lower surface of an associated blade adjacent to the interior edge. Three threaded fasteners 36 extend downwardly through each blade and threadedly received into an associated exterior component. Each coupling assembly also includes an interior component 38 joining an associated exterior component to the central base. The coupling assemblies are fabricated of metal, Next provided are five similarly configured pads 42. Each pad is in an elongated configuration in a generally horizontal plane with generally parallel side edges 44 and an arcuate convex interior edge 46 and an arcuate convex exterior edge 48. The exterior and interior edges each have a center of curvature with the center of curvature of the exterior edges having a greater radius of curvature than the radius of curvature of the interior edges. The side edges and exterior edges and interior edges of the pad form a blade periphery. The blade periphery is larger than the pad periphery thereby forming a peripheral space 50 between the blade periphery and the pad periphery. The peripheral space 52 at the interior edges of the blade and pad is greater than the peripheral space 54 remote from the interior edges of the blade and pad. The pads each have an upper surface 56 and a lower surface 58. The pads are fabricated of a synthetic material chosen from the class of synthetic materials including polyesters, polyamides and polypropylenes. The synthetic material is formed of strands having a diameter of from 1.0 to 1.3 deniers.

Particles 62 of a scented additive are loaded between the fibers of the pad to dispense a pleasant aroma into air in proximity to the pads and the fan blades during operation and use of the system. In other embodiments of the invention, no scented additive is provided.

Next, a plurality of peel strips 66 are provided. Each peel strip has a size and shape of an associated pad. An adhesive 68 is in contact with the lower surface of each pad removably coupling the lower surface of each pad to one of the peel strips. The peel strips are adapted to be removed from the pads and the pads removably coupled to the upper surfaces of the blades.

Lastly, a motor 72 is within the central base selectively operable by a user to rotate the blades with the pads. In this manner, air is moved to move dust, pollen, air pollutants, airborne chemicals, various molds, spores, and harmful fibers in the environment in a room with the fan whereby the moved dust, pollen, air pollutants, airborne chemicals, various molds, spores, and harmful fibers in the environment will contact the pads and become entrapped to clean the room. The pads are adapted to be removed from the blade after extended use and replaced by a new pad.

The product will be available in two forms, scented and non scented, neither of which will have a cover sheet over the microfiber material itself. The scenting will be contained merely by the packaging itself.

An alternate embodiment of the invention is illustrated in FIG. 7. In such embodiment, the system 100 further includes a sheet of a scented additive 106 to dispense a pleasant aroma to the pads 104 and then into air in proximity to the pads and the fan blades during operation and use of the system. The sheet of scented additive remains with and is discarded with the packaging after installation of the pads. As in the primary embodiment, the layer of adhesive 108 is on the pad opposite from the scented additive.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air particle collection pad adhered to a fan blade (10) system for adhesively coupling collection pads to upper surfaces of ceiling fan blades and for rotating the ceiling fan blades and collection pads to attract and collect dust, pollen, air pollutants, airborne chemicals, various molds, spores, and harmful fibers in the environment, the system comprising in combination:

a ceiling fan (14) having a central base (16) with five similarly configured ceiling fan blades (18), the central base depending from and adjacent to a ceiling of a room to be cleaned and cooled, each ceiling fan blade of the five similarly configured ceiling fan blade having an upper surface (20) and a lower surface (22), each blade having an elongated configuration in a generally horizontal plane with parallel side edges (24) and an arcuate convex interior edge (26) and an arcuate convex exterior edge (28), the exterior and interior edges each having a center of curvature with the center of curvature of the exterior edge having a greater radius of curvature than the radius of curvature of the interior edge, the side edges and exterior edges and interior edges of the blade forming a blade periphery, the blades being fabricated of a rigid material;

five similarly configured coupling assemblies (32), each coupling assembly including an exterior component (34) in an arcuate configuration positioned on the lower surface of an associated blade adjacent to the interior edge, three threaded fasteners (36) extending downwardly through each blade and threadedly received into an associated exterior component, each coupling assembly also including an interior component (38) joining an associated exterior component to the central base, the coupling assemblies being fabricated of metal;

five similarly configured pads (42), each pad including an having an elongated configuration in a generally horizontal plane with generally parallel side edges (44) and an arcuate convex interior edge (46) and an arcuate convex exterior edge (48), the exterior and interior edges each having a center of curvature with the center of curvature of the exterior edge having a greater radius of curvature than the radius of curvature of the interior edge, the side edges and exterior edges and interior edges of the pad forming a blade periphery, the blade periphery being larger than the pad periphery thereby forming a peripheral space (50) between the blade periphery and the pad periphery, the peripheral space (52) at the interior edges of the blade and pad being greater than the peripheral space (54) remote from the interior edges of the blade and pad, the pads each having an upper surface (56) and a lower surface (58), the pads being fabricated of a synthetic material chosen from the class of synthetic materials including polyesters, polyamide and polypropylenes, the synthetic material being formed of strands having a diameter of from 1.0 to 1.3 deniers;

particles (62) of a scented additive loaded between the fibers of the pad to dispense a pleasant aroma into air in proximity to the pads and the fan blades during operation and use of the system;

a plurality of peel strips (66), each peel strip having a size and shape of an associated pad, an adhesive (68) in contact with the lower surface of each pad removably coupling the lower surfaces of each pad to the peel strips, the peel strips adapted to be removed from the pads and the pads removably coupled to the upper surfaces of the blades; and a motor (72) within the central base selectively operable by a user to rotate the blades with the pads whereby air is moved to move dust, pollen, air pollutants, airborne chemicals, various molds, spores, and harmful fibers in the environment in a room adjacent to the fan and whereby the moved dust, pollen, air pollutants, airborne chemicals, various molds, spores, and harmful fibers in the environment will contact the pads and become entrapped to clean the room, the pad adapted to be removed from the blade after extended use and replaced by a new pad.

* * * * *